United States Patent [19]

Masuda

[11] Patent Number: 4,595,805

[45] Date of Patent: Jun. 17, 1986

[54] SWITCH STRUCTURE COMPRISING RECESSED CONTACTS

[75] Inventor: Toru Masuda, Higashi-Osaka, Japan

[73] Assignee: Hosiden Electronics Co., Ltd., Osaka, Japan

[21] Appl. No.: 653,106

[22] Filed: Sep. 21, 1984

[30] Foreign Application Priority Data

Sep. 30, 1983 [JP] Japan ..... 58-183895
Sep. 30, 1983 [JP] Japan ..... 58-153211[U]

[51] Int. Cl.[4] ..... H01H 13/10

[52] U.S. Cl. ..... 200/6 R; 29/622; 200/51 R

[58] Field of Search ..... 200/6 R, 6 A, 6 B, 6 BA, 200/6 BB, 6 C, 51 R, 292, 284; 361/352, 421; 29/622

[56] References Cited

U.S. PATENT DOCUMENTS 3,541,497 11/1970 Kato ..... 339/242
3,900,709 8/1975 Sheesley et al. ..... 200/153 L X
4,090,293 5/1978 Donk et al. ..... 29/628
4,269,467 5/1981 Hughes ..... 339/126 R
4,273,402 6/1981 Hughes ..... 339/91 R
4,274,691 6/1981 Abernethy et al. ..... 339/19
4,367,907 1/1983 Buck ..... 339/113 R
4,423,288 12/1983 Webb ..... 339/176 M
4,451,106 5/1984 Wiseheart ..... 339/123

*Primary Examiner*—A. D. Pellinen
*Assistant Examiner*—Morris Ginsburg
*Attorney, Agent, or Firm*—Jones, Tullar & Cooper

[57] ABSTRACT

This invention discloses a switch structure wherein a plurality of metallic contacts are recessed in a contact holding member of electrical insulating material, each contact is arranged not to overlap one another when each contact is developed on the same plane, and by bending a part not to be recessed of at least one contact a contact area is formed facing a corresponding contact area formed on the part not be recessed of another contact so as to perform a relative contacting and separating operation.

10 Claims, 23 Drawing Figures

SWITCH STRUCTURE COMPRISING RECESSED CONTACTS

CROSS-REFERENCE TO RELATED APPLICATION

This application discloses certain subject matter in common with application, Ser. No. 653,105, filed Sept. 21, 1984 to the same assignee.

BACKGROUND OF THE INVENTION (1) Field of the Invention

This invention relates to a switch structure comprising a plurality of contacts or contact segments (hereinafter called "contact") recessed into a contact holding member to be held therein, and performing a certain switching function by putting a plug in and out, individually or in combination with a jack or the like.

(2) Description of the Prior Art

In the known switch structure, it is conventional that each contact is held in a contact holding member in such a manner as engagedly fixed to each groove formed on said contact holding member of some electrical insulating material taking advantage of resiliency of the material.

Accordingly, it is difficult to carry out formation of each contact, formation of contact holding member and incorporation of each contact into the contact holding member continuously on the same line, and it seems almost impossible to realize the automation in manufacturing of the contact holding member while holding the plurality of contacts therein. For that reason, it is general to conduct manually the incorporation of each contact into the contact holding member. And in such manual incorporation, there inevitably arise such problems as irregularity in accuracy depending upon the experience or skill of the worker, tarnish on the plated surface of the contact due to stains which stick thereto when handling the contact, imperfect contact or the like.

Furthermore, since the contacts are simply fixedly engaged to the contact holding member in case of the prior art, there is a possibility of producing unexpected play or looseness in the contacts caused by some error in the manufacturing or assembling process or by a long period of use resulting in deviation in accuracy of the product.

SUMMARY OF THE INVENTION

Objects of the Invention

An object of this invention is therefore to provide a switch structure in which a step of punching contacts as well as a step of incorporating the contacts into the contact holding member, i.e. a process of molding the contact holding member while the contacts being inserted therein can be continuously carried out on the same line, thereby automation in manufacuring the switch structure is made feasible.

Another object of this invention is to provide a switch structure in which a manual process of manufacture is eliminated by the automation thereof, thereby the switch structure is efficiently obtained at reasonable cost.

A further object of this invention is to provide a switch structure in which each contact can be securely held in the contact holding member, and the accuracy thereof is higher in association with the feature of eliminating the problem of stain, which is incidental to the manual process, by introducing an automatic manufacturing method thereof.

A still further object of this invention is to provide a switch structure in which the necessary quantity of such costly plating material as silver required for securing high electro-conductivity of each contact is reduced to as small a quantity as possible in view of cost saving.

A yet further object of this invention is to provide a switch structure in which the formation or manufacture of a jack into which the switch structure is incorporated are also easy and simplified.

Other objects, feastures and advantages of this invention will become apparent in the course of the following description together with the accompanying drawings.

BRIEF DESCRIPTION OF THE DRAWINGS

In the accompanying drawings forming a part of this application, and in which like parts are designated reference numerals throughout the same.

DESCRIPTION OF THE PREFERRED EMBODIMENTS

Referring now to the accompanying drawings, a first embodiment in accordance with this invention is illustrated in FIGS. 1 to 4. This embodiment comprises a switch structure incorporated in a jack.

Figure 1:
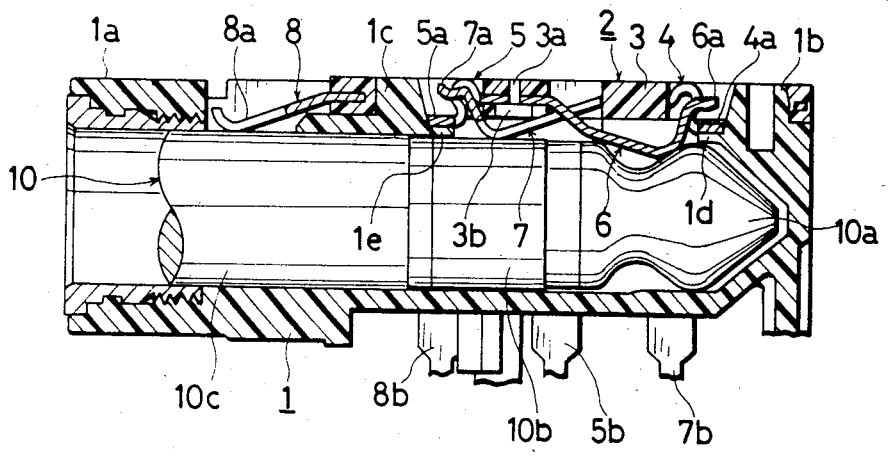
FIG. 1 is a longitudinal sectional view of a jack in which a plug is inserted illustrating a first embodiment.

The jack of FIG. 1 comprises a box-shaped jack body 1 with its upper side open, and a switch structure 2 engagedly fixed to the upper opening of the body 1. The switch structure 2 comprises two pairs of stationary contacts 4, 5 and movable contacts 6, 7 of which contacting and separating operation (or connection and disconnection) is conducted by putting a plug 10 in and out, a movable contact 8 performing the contacting and separating operation directly with respect to the plug 10 by putting the same in and out, and a contact holding member 3 of rectangular plate in which said contacts 4 to 8 are recessed to be held therein. Said jack body 1 and the contact holding member 3 are molded of electrical insulating resin material. A plug insertion cylinder 1*a* (or plug receiving cylinder) is provided on the front wall of the jack body 1.

Said switch structure 2 is integrally formed by the following described process while the first and second stationary contacts 4, 5 as well as the first, second and third movable contacts 6, 7, 8 are inserted in the contact holding member 3.

Figure 3:
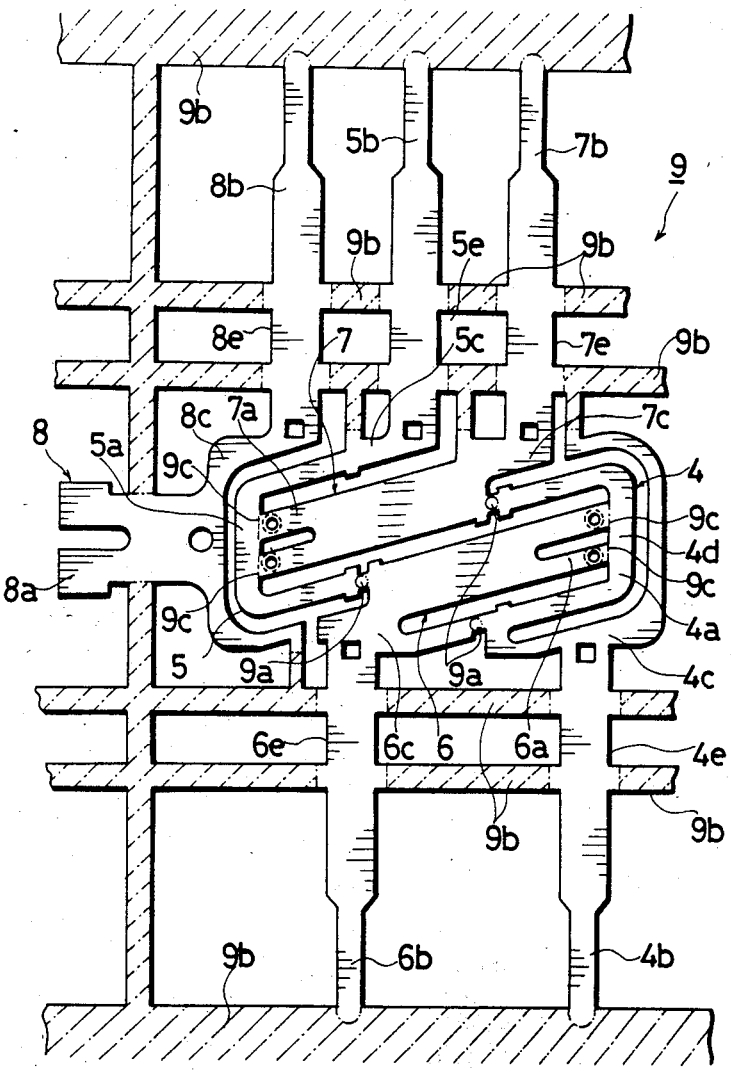
FIG. 3 is a plan view of a contact collection plate.
Figure 4:
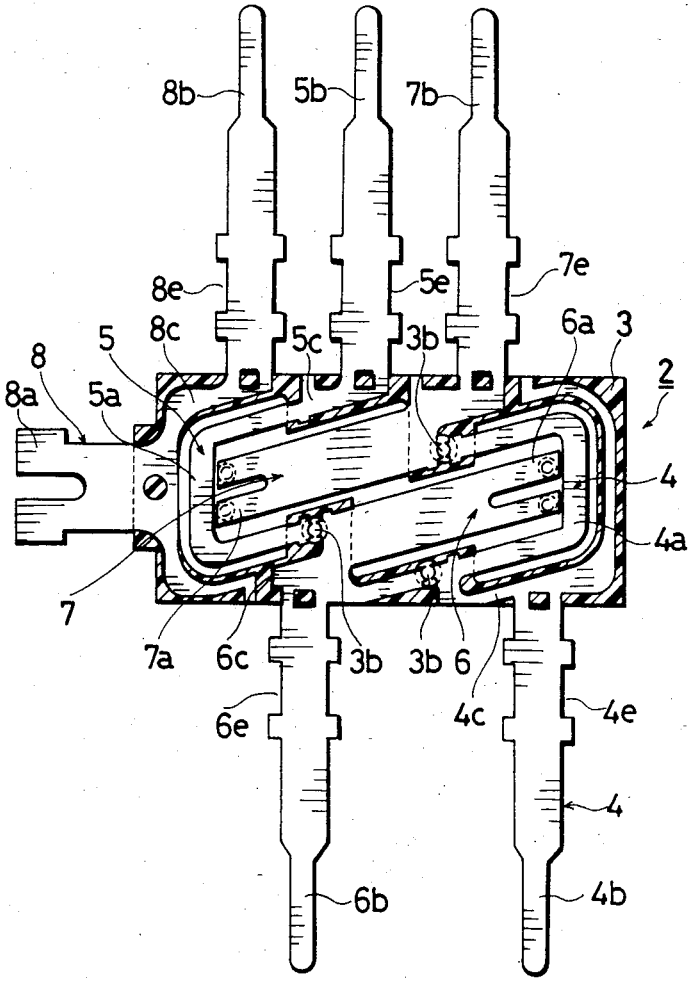
FIG. 4 is a transverse sectional view of a switch structure illustrating each contact in the developed state.

In the first step, as illustrating in FIG. 3, a metal plate is punched to obtain a contact collection plate 9 in which each contact 4 to 8 is collectively placed connecting each other in any part thereof and not to overlap each other on the same plane. In this step, it is preferred that as the case may be, relatively slight bending or projecting parts are formed beforehand to the extent not affecting the planeness of the contact collection plate 9. In this first embodiment, such projecting parts or projections are formed on each end of contact areas 6*a*, 7*a* of the first and second movable contacts 6, 7.

Then, in order to secure satisfactory electro-conductivity of each contact 4 to 8, a highly electro-conductive film is formed on both sides of the contact collection plate 9. Namely, such electro-conductive material as silver is plated on both sides of the collection plate 9. Such plating, however, is not necessary when using the same plated material or clad material as said plate.

The contact holding member 3 is formed by injection molding in a cavity between a male mold and a corresponding female mold (not illustrated). In this step, the contact collection plate 9 is horizontally held while a part to be recessed being placed in said cavity, said part to be recessed having each communicating portion 4*c* to 8*c* between each contact area 4*a* to 8*a* and each terminal 4*b* to 8*b* of each contact 4 to 8 and having each portion 9*a* (to be cut off later) connecting between each end of each contact area of the first contacts 4, 6 and each end of each contact area of the second contacts 5, 7.

In the next step, each unnecessary portion 9*b* (indicated by the hatching portion in FIG. 3) of the contact collection plate 9 is removed, and each portion 9*c* connecting each end of each contact area of the first contacts 4, 6 and each end of each contact area of the second contacts 5, 7 as well as said portion 9*a* are cut off respectively. Thus, the contact holding member 3 is obtained while each contact 4 to 8 is recessed and held in the separate state (see FIG. 4). In this respect, as said portion 9*a* to be cut off is in a recessed state in a resin layer, cutting them off is conducted using through holes 3*a*, 3*b* provided vertically on the upper and lower sides of the portion 9*a* for introduction of a punching tool.

Then, a part not to be recessed of each contact 4 to 8 is bent to form the contact area for the jack circuit. Namely, each contact area 6*a*, 7*a*, 8*a* of each movable contact 6, 7, 8 is bent downward forming <-shape, and each contact area 4*a*, 5*a* of each stationary contact 4, 5 is bent under the corresponding contact area 6*a*, 7*a* of each movable contact 6, 7. Then the bending portions of each movable contact 6, 7, 8 are projected or extended downward from the under side of the contact holding plate 3 to a certain extent, and each contact area 6*a*, 7*a* of each movable contact 6, 7 is resiliently brought into contact with each contact area 4*a*, 5*a* of each stationary contact 4, 5.

Further, each terminal portion 4*b* to 8*b* of each contact 4 to 8 is bent to extend downward from the left and right sides of the contact holding member 3 respectively.

Figure 2:
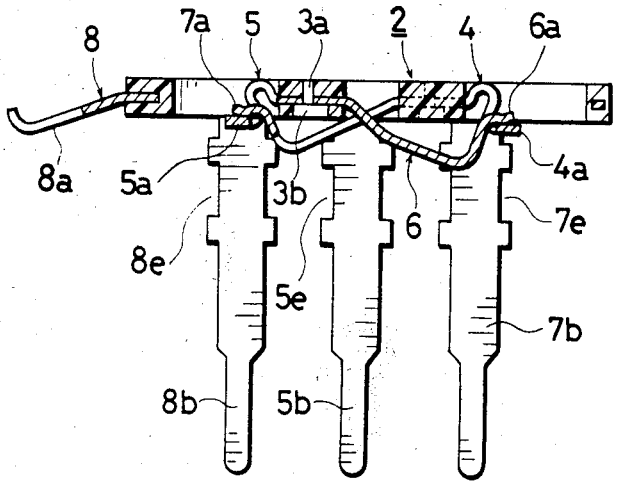
FIG. 2 is a longitudinal sectional view of a switch structure.

In this manner, the switch structure 2 in which each contact 4 to 8 is recessed in the contact holding member 3 to be held therein is satisfactorily obtained or manufactured as illustrated in FIG. 2.

The switch structure 2 thus obtained is engagedly fixed to the upper opening of the body 1 while the areas to be in contact with the plug 10, i.e. the bent portions of each contact area 6*a*, 7*a*, 8*a*, are projected inside the plug insertion passage by engaging the contact holding member 3 with engaging parts 1*b*, 1*c* formed on the upper part of the body 1 and by engaging the recessed parts 4*e* to 8*e* formed on the terminals 4*b* to 8*b* of each contact 4 to 8 with each engaging parts (not illustrated) formed on the left and right sides of the body 1, respectively. In this respect, each contact area 4*a*, 5*a* of each stationary contact 4, 5 is supported on the supporting parts 1*d*, 1*e* formed on the body 1.

In the jack constructed as above-described, when inserting the plug 10 therein through the plug insertion cylinder 1*a*, each contact area 6*a*, 7*a*, 8*a* of the first, second and third movable contact 6, 7, 8 comes in contact with a chip 10*a*, a ring 10*b* and a ground device 10*c* respectively so that each contact area 6*a*, 7*a* of the first and second contacts 6, 7 is separated upward from each corresponding contact area 4*a*, 5*a* of the first and second stationary contacts 4, 5 (see FIG. 1).

By employing the foregoing construction, the step of obtaining the contact collection plate 9 from a metal plate, the step of injection molding the contact holding member 3 while the contact collection plate 9 being inserted therein, and the step of obtaining each contact 4 to 8 separated from the contact collection plate 9 and bent to a required shape can be continuously carried out on the same line. Thus the automation in manufacturing the switch structure 2 while each contact 4 to 8 is recessed into the contact holding member 3 is made feasible with ease. Consequently, the manual work required in the known art is no longer necessary and the manufacture of the switch structure, or eventually the manufacture of the whole jack can be efficiently carried out contributing much to the provision of the jack at reasonable cost. Besides there is no problem incidental to the manual work as mentioned above.

Further, since each contact 4 to 8 is recessed in the contact holding member 3 to be held therein, each contact 4 to 8 is more securely held than the known art where each contact is simply fixed engagedly, and there is no such problem as producing unexpected play or looseness in the contacts 4 to 8. And by bending each contact 4 to 8 after being recessed in the contact holding member 3 as above-described, accuracy in the relative position of each contact 4 to 8 can be greatly improved.

Furthermore, it is not necessary to provide such portions with which each contact is to be engaged as is required in the known art. In other words, it becomes unnecessary to provide a rather thick resin layer for securing the engaging parts, resulting in the realization of a thin, small-sized jack.

Moreover, the switch structure 2, particularly the contact holding member 3, serves as an upper wall of the jack body, thereby decreasing the number of necessary components.

Since each terminals 4*b* to 8*b* of each contact 4 to 8 is provided extending down from the contact holding member 3 mounted on the upper side of the body 1, there also arises the advantage of sufficiently securing a spacing for keeping from the entrance an invasion of flux.

The manner of forming the switch structure 2 is not limited to the first embodiment. For example, the switch structure 2 can be formed in a manner described in the following second to eighth embodiments.

Figure 5:
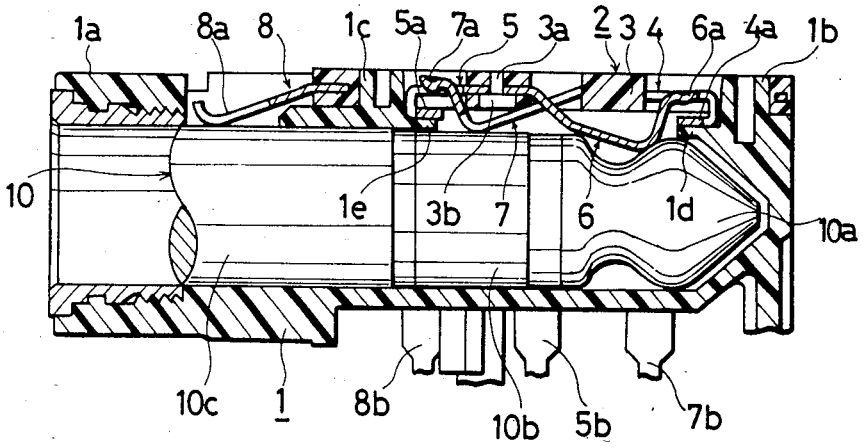
FIG. 5 is a longitudinal sectional view of a jack in which a plug is inserted illustrating a second embodiment.
Figure 6:
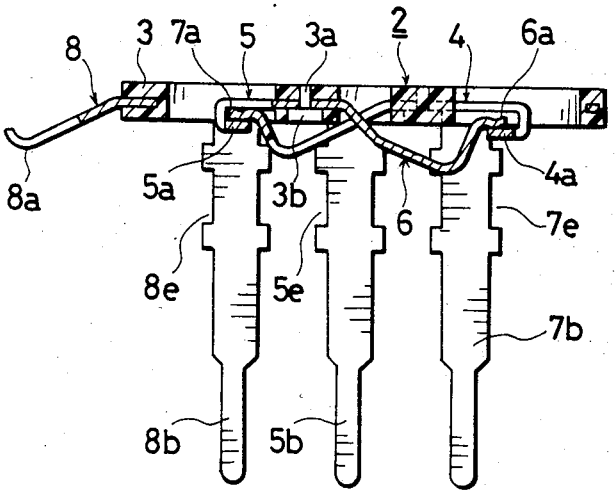
FIG. 6 is a longitudinal sectional view of a switch structure.

In the second embodiment illustrated in FIG. 5 and FIG. 6, the contact areas 4*a*, 5*a* of each stationary contact 4, 5 are bent downward forming a ]-shape, although such other features as formation of the contact collection plate 9 are the same as the preceeding first embodiment.

By employing such a construction, the contact face between each contact area 4*a*, 5*a* of each stationary contact 4, 5 and each contact area 6*a*, 7*a* of each movable contact 6, 7 as well as the contact face between each movable contact 6, 7, 8 and the plus 10 is to be located on one side or the under side of the contact collection plate 9 illustrated in FIG. 3, and it is not necessary to provide said electro-conductive film on both sides of the contact collection plate 9, in view of securing the electro-conductivity, as is required in the case of the first embodiment. Thus only plating one side of the collection plate 9 (or metal plate) is suffcient for securing the electro-conductivity, thereby the required quantity for such costly material as silver is reduced or decreased resulting in a considerable cost saving.

Although in the foregoing first and second embodiments, such unexpected trouble as dislocation downward of said each contact area 4*a*, 5*a* as a result of resilient contact with each corresponding contact area 6*a*, 7*a* of the movable contacts 6, 7 is to be exactly prevented by retaining or supporting each contact area 4*a*, 5*a* of the stationary contacts 4, 5 on the supporting parts 1*d*, 1*e* formed on the body 1, it is not always necessary to form such supporting parts 1*d* 1*e* particularly on the body 1. It is also possible to form the supporting parts (not illustrated) performing the same function as the parts 1*d*, 1*e* on the contact holding member 3.

Figure 7:
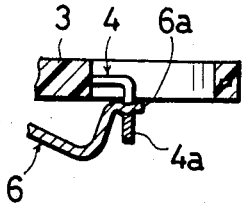
FIG. 7 is a longitudinal sectional view of a switch structure illustrating a third embodiment.

Further, in the third embodiment illustrated in FIG. 7, each contact area 4*a*, 5*a* of each stationary contact 4, 5 is bent downward forming an L-shape so as to be orthogonal to each contact area 6*a*, 7*a* of each movable contact 6, 7 (the second stationary contact is not illustrated). By employing such a construction, the rigidity of each contact area 4*a*, 5*a* of the stationary contact 4, 5 can be greatly improved compared with the first and second embodiments, and said supporting parts 1*d*, 1*e* on the body 1 or the equivalent parts on the contact holding member 3 need not necessary be formed, thereby the shape or configuration of the body 1 or the contact holding member 3 is simplified.

Figure 8:
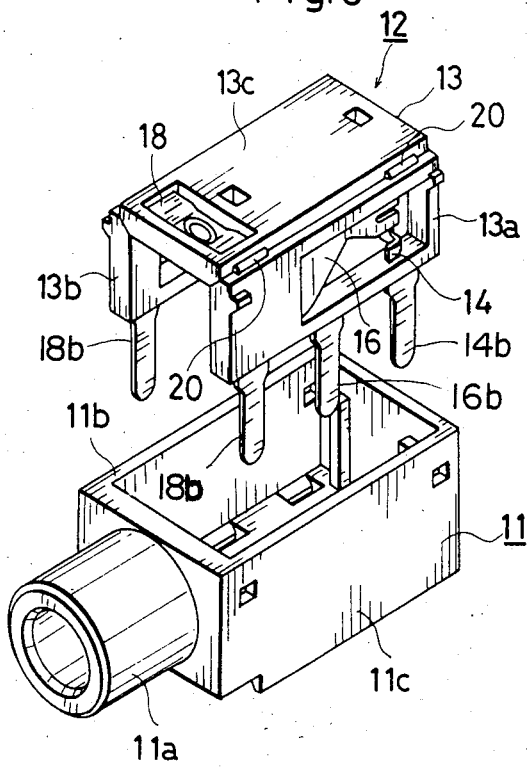
FIG. 8 is an exploded perspective view of a jack illustrating a fourth embodiment.
Figure 9:
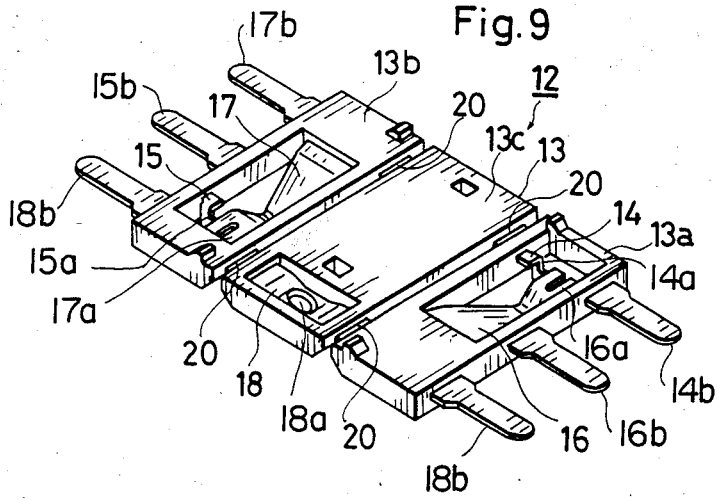
FIG. 9 is a perspective view of a switch structure in the state before assembling.
Figure 10:
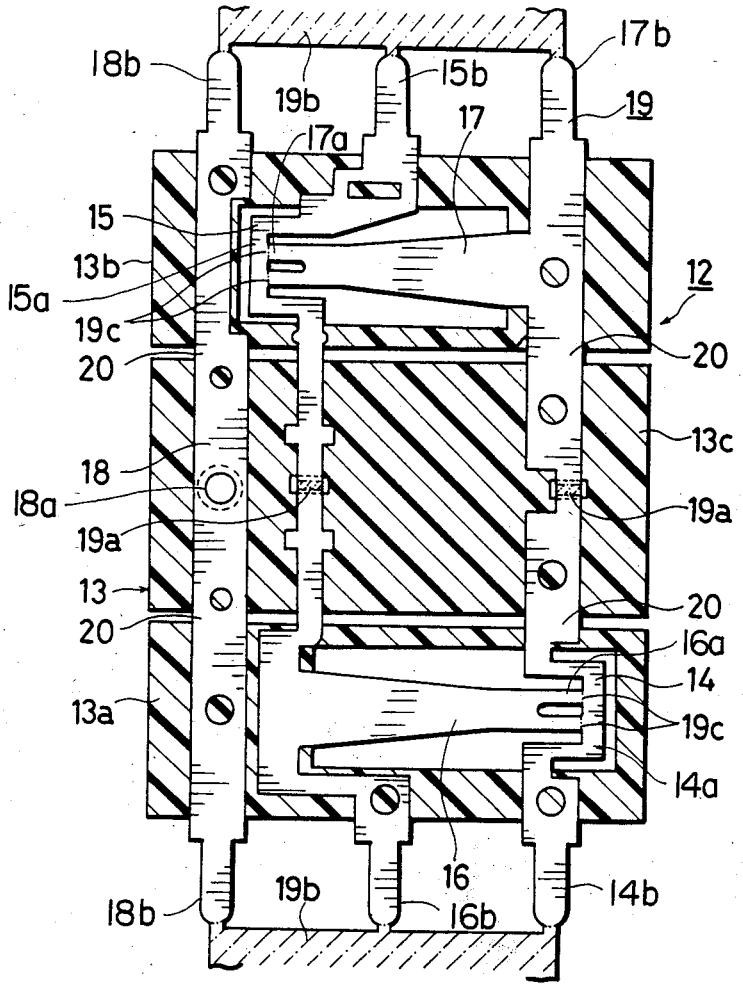
FIG. 10 is a transversal sectional view of a switch structure in which a contact collection plate is recessed.

Furthermore, in the fourth embodiment illustrated in FIGS. 8 to 10, a contact holding member 13 of a switch structure 12 is formed into a ]-shape comprising a first contact holding member 13*a* in which a first stationary contact 14 and a first movable contact 16 are recessed to be held therein, a second contact holding member 13*b* in which a second stationary contact 15 and a second movable contact 17 are recessed to be held therein, and a third contact holding member 13*c* connected with said two contact holding members 13*a*, 13*b* through connecting pieces 20, 20 and in which a third movable contact 18 is recessed to be held therein, said each contact holding member 13*a*, 13*b*, 13*c* being flat faced. The switch structure 12 is incorporated into a box-shaped jack body 11 with its upper side open and equipped with a plug insertion cylinder 11*a* (plug receiving cylinder) in such a manner that said first and second contact holding members 13*a*, 13*b* overlap each other and come in contact with the inner surface of side walls 11*b*, 11*c* of the body 11. In this respect, said each connecting piece 20 is formed on a part of the contact. By employing such a construction, since the side walls 11*b*, 11*c* of the body 11 and the first and second contact holding members 13*a*, 13*b* overlap each other, the rigidity of the jack body 11 is much improved. The formation of the ]-shaped contact holding member 13 is easily conducted by bending each connecting piece 20 after molding the member 13 into a flat plate as illustrated in FIG. 9, thereby the automation in manufacturing the switch structure 12 being also feasible in the same manner as each foregoing embodiment. Further in this fourth embodiment a contact collection plate 19 is formed by punching to such a shape as illustrated in FIG. 10. And after each contact holding member 13*a*, 13*b*, 13*c* is formed by injection molding while a part to be recessed of said contact collection plate 19 is placed in each cavity, every unnecessary portion 19*b* (hatching portion in FIG. 10) is removed, each portion 19*a*, 19*c* between the contacts is cut off, and each contact area 14*a* to 18*a* of each contact 14 to 18 as well as each terminal 14*b* to 18*b* is bent to be formed into the required shape. Thus, the switch structure 12, the developed state of which is illustrated in FIG. 9, is obtained. In this case, although each connecting member 20 is formed of a part of each contact as mentioned above, it is also possible for the member 20 to be of either a metallic piece or a resin film or a coating separate from the contact as a matter of course.

Figure 11:
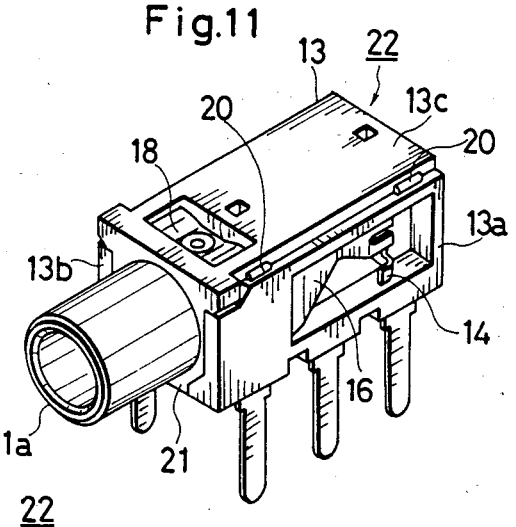
FIG. 11 is a perspective view of a jack illustrating a fifth embodiment.
Figure 12:
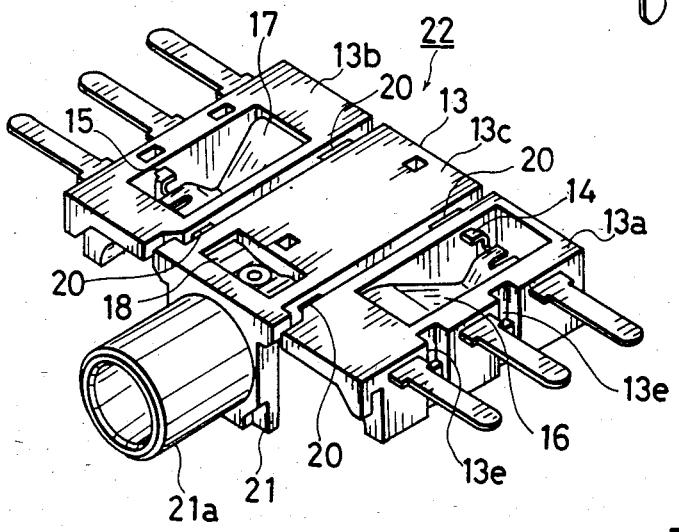
FIG. 12 is a perspective view of a jack in the state before assembling.
Figure 13:
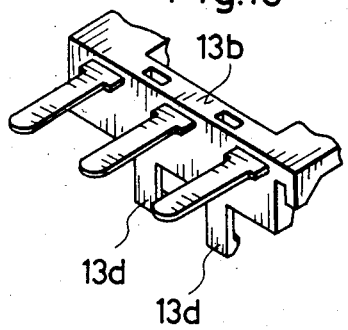
FIG. 13 is a perspective view of an essential part viewed from a different angle from that of FIG. 12.

In the foregoing fourth embodiment, the body 11 and the contact holding member 13 are manufactured separately. On the other hand, in the fifth embodiment illustrated in FIGS. 11 to 13, the body and the contact holding member are integrally formed. More particularly, as illustrated in FIG. 12, the contact holding member 13 and a front wall member 21 are formed integrally by injection molding into a developed state together while each contact 14 to 18 is inserted therein, said front wall member 21 being equipped with the plug insertion cylinder 21*a* on the front end of the third contact holding member 13*c* extending down therefrom. Then the first and second contact holding members 13*a*, 13*b* are turned downward through each connecting piece 20, and by engaging each pawl 13*d* formed on the second contact holding member 13*a* with each recessed portion 13*e* formed on the first contact holding member 13*a*, a switch structure 22 or a jack is obtained as illustrated in FIG. 11. The remaining formation is the same as the fourth embodiment. By employing such a construction, not only the switch structure but also the whole jack including the switch structure can be easily manufactured by automation. In this respect, in each of the fourth and fifth embodiments, the first, second and third movable contacts 16, 17, 18 are brought into contact with said chip 10*a*, ring 10*b* and ground device 10*c* respectively.

In the foregoing fifth embodiment, it is also possible that the third contact holding member 13*c* and the front wall member 21 are separately made and then said holding member 13*c* and the front wall 21 are connected to each other through some connecting piece (not illustrated). By such a formation, each member 13, 21 can be of suitable material satisfying the intended function or operation thereof. In view of preventing the plug 10 from abrasion due to putting it in and out repeatedly, the front wall can be made of some abrasion resisting material, while each contact holding member 13*a*, 13*b* 13*c* is made of some heat resisting material.

Figure 14:
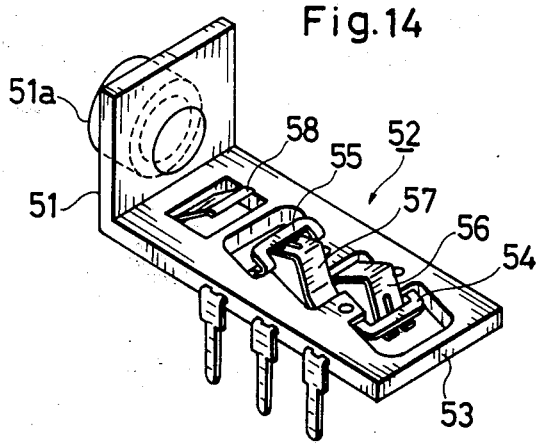
FIG. 14 is a perspective view of a jack illustrating a sixth embodiment.

In the case of the following sixth embodiment illustrated in FIG. 14, a front wall member 51 equipped with a plug insertion cylinder 51*a* is integrally formed on the front end of the contact holding member 53 in which first, second and third movable contacts 56, 57, 58 are recessed to be held therein. Thus, a switch structure 52 is constructed having the performance of a jack itself. By employing such a construction, the jack can be obtained in the finished state resulting in the provision of the jack at reasonable cost. Concerning the formation of each contact 54 to 58 as well as the contact holding member 53 including the front wall member 51, the same method as the preceeding embodiments can be employed as a matter of course.

In each of the above-described first through sixth embodiments, the switch structure in accordance with this invention is incorporated in a jack or serves as a jack itself, but the switch structure is further applicable to a connector for use in the connection of printed circuit boards.

Figure 15:
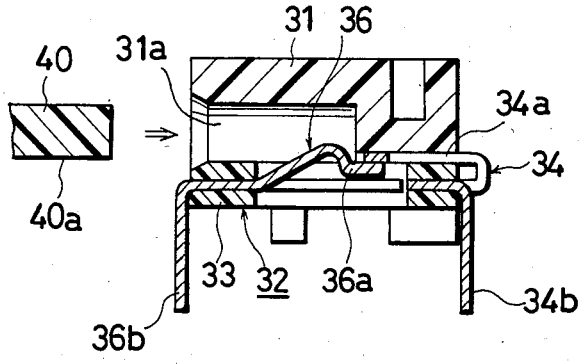
FIG. 15 is a longitudinal sectional view of a connector illustrating a seventh embodiment.
Figure 16:
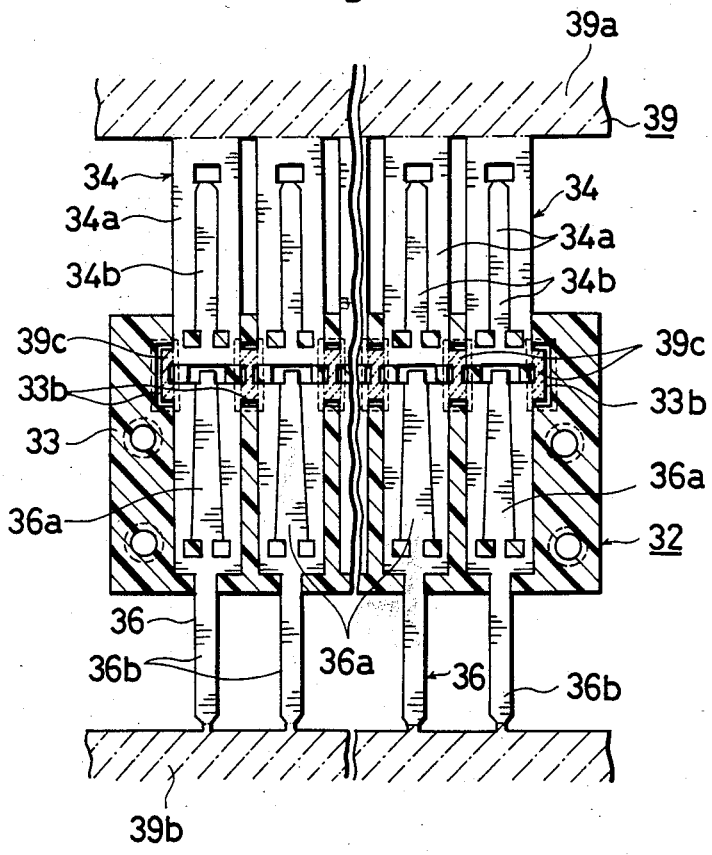
FIG. 16 is a transverse sectional view of a switch structure in which a contact collection plate is recessed.
Figure 17:
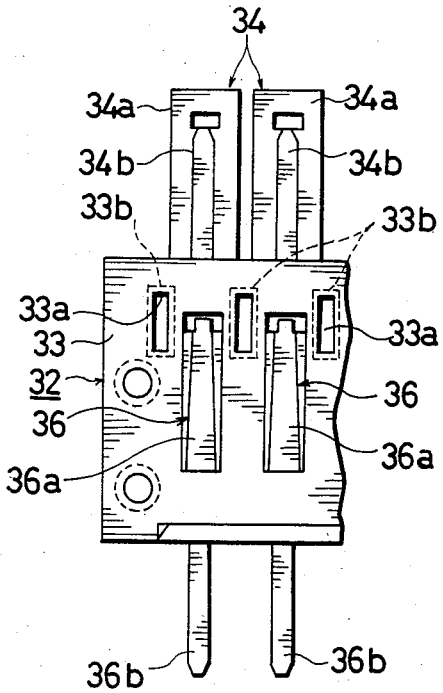
FIG. 17 is a partially cutaway view of a switch structure illustrating each contact in the developed state.
Figure 18:
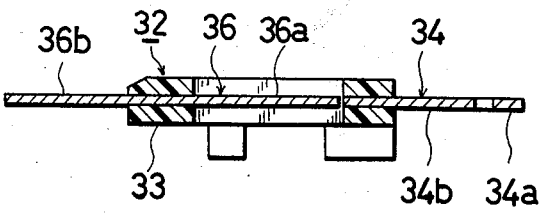
FIG. 18 is a longitudinal sectional view of a switch structure in the same state as FIG. 17.

In the seventh embodiment illustrated in FIGS. 15 to 18, a connector comprises a switch structure 32 having a contact holding member 33 of electrical insulating material in which several pairs of stationary contacts 34 and movable contacts 36 to come in contact with said contacts 34 in the normal state are arranged in parallel to be recessed and held therein, and a connection body 31 of electrical insulating material having a printed circuit board insertion opening 31*a* formed between or in association with said holding member 33. Thus when inserting a printed circuit board 40 into the insertion opening 31*a*, each contact area 36*a* of each movable contact 36 is separated (or disconnected) from each corresponding contact area 34*a* of each stationary contact 34, and said each contact area 36*a* is brought into contact with each pattern 40*a* of the printed circuit board 40 to be conducting therewith. Said contact holding member 33 is formed by injection molding of resin material in the same manner as each foregoing embodiment while each contact 34, 36 is inserted therein. More particularly, a metal plate is punched to be formed into a contact collection plate 39 the shape of which is illustrated in FIG. 16, and the contact holding member 33 is formed by injection molding while the part to be recessed of the contact collection plate 39 is placed in the cavity. Then the hatching portion of FIG. 16, i.e. first portion 39*a* connected between each end of each contact area 34*a* of each stationary contact 34, the second portion 39*b* connecting each end of each contact area 36*a* of each movable contact 36 and the third portion 39*c* connected between each stationary contact 34 and each movable contact 36 are cut off respectively to obtain separate stationary contacts 34 and movable contacts 36 (FIG. 17 and FIG. 18), and each terminal 34*b*, 36*b* of each contact 34, 36 is bent as illustrated in FIG. 15. In this case, said portion 39*c* is cut off using through holes 33*a*, 33*b* provided vertically on the upper and lower sides for introduction of a punching tool. By employing such formation, advantages similar to the preceeding embodiments are performed in the aspect of manufacture and accuracy of the connector. Particularly, since the connector usually has a large number of contacts, such advantages are significant.

In the foregoing seventh embodiment, although the connector body 31 and the switch structure 32 are separately formed beforehand and assembled into one connector later, it is also possible to form beforehand said body 31 and the structure 32 together in the developed state connecting each other through some connecting piece formed of a part of the collection plate as is the case in the fourth and fifth embodiment, and then assembling them into a connector by bending said integrated body 31 and structure 32. In this case, each contact can be recessed not only in the contact holding member but also in the connector body 31. Thus, a printed circuit board having its pattern on both sides is applicable to the connector. It is further possible that by bending each contact area 34*a* of each stationary contact 34 under the contact holding member 33, inverting the state illustrated in FIG. 15, each movable contact 36 is brought into contact with each stationary contact 34 when inserting the printed circuit board 40.

Although the switch structure in accordance with this invention is applied to such other device as a connector, jack, etc., in each of the preceeding first and seventh embodiments, it is further possible to form the switch structure 42 to be used as an individual switch itself, which is the eighth embodiment of this invention as illustrated in FIGS. 19 to 23.

Figure 19:
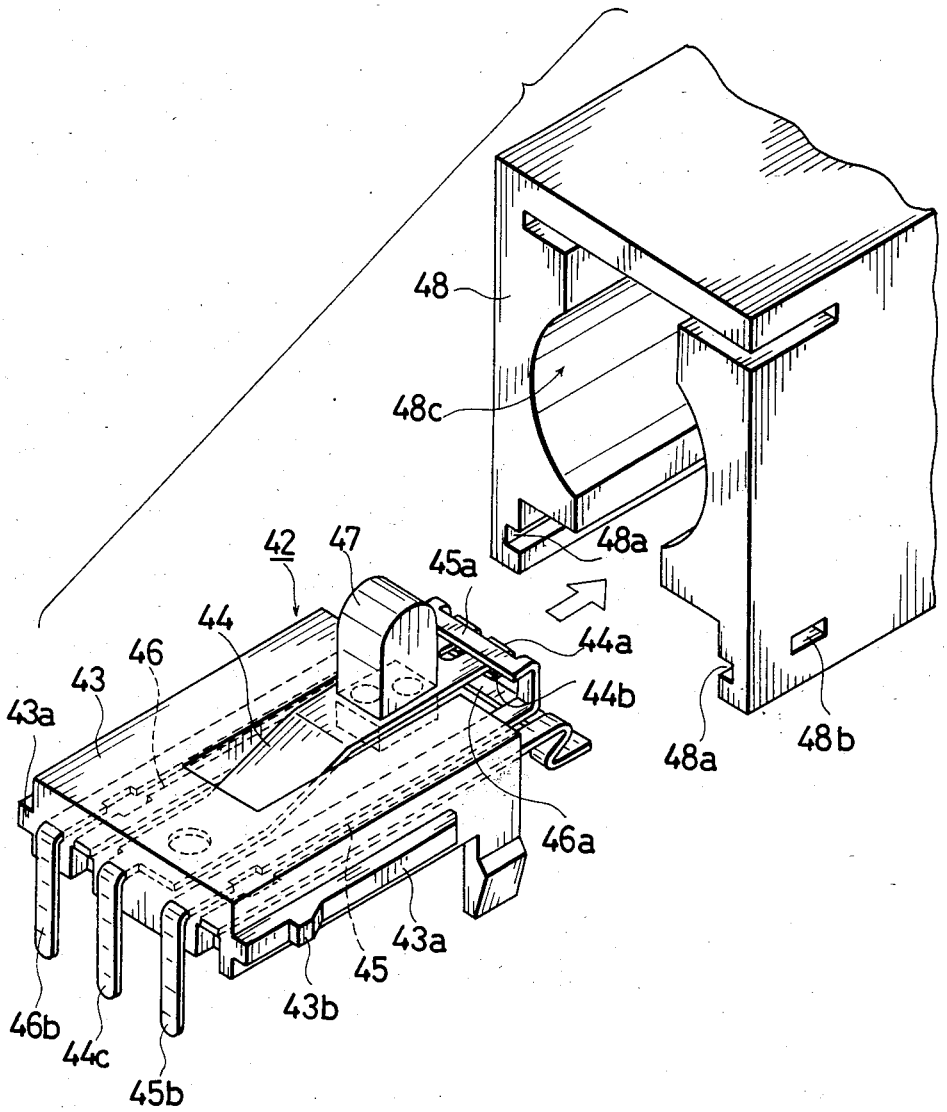
FIG. 19 is a perspective view of a switch structure illustrating an eighth embodiment.
Figure 20:
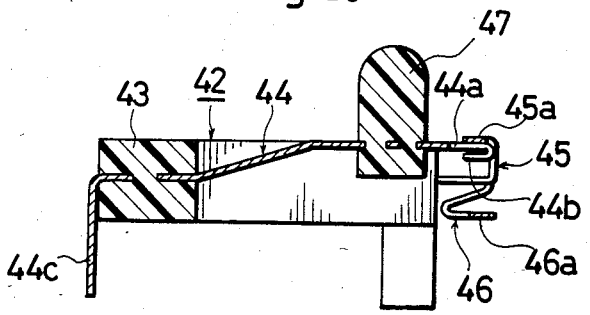
FIG. 20 is a longitudinal sectional view of a switch structure.

The switch illustrated in FIG. 19 and FIG. 20 incorporates a switching mechanism comprising a movable contact 44 and first and second stationary contacts 45, 46 into a contact holding member 43, and by pressing down an operation member 47 of electrical insulating material fixed to said movable contact 44 the first contact area 44*a* of the movable contact 44 comes to separate from the contact area 45*a* of the first stationary contact 45, and the second contact area 44*b* of the movable contact 44 comes in contact with the contact area 46*a* of the second stationary contact 46 so that changeover of the circuit is sufficiently performed.

Said switch, i.e., the switch structure 42 is manufactured according to the same process as the foregoing embodiments.

Figure 21:
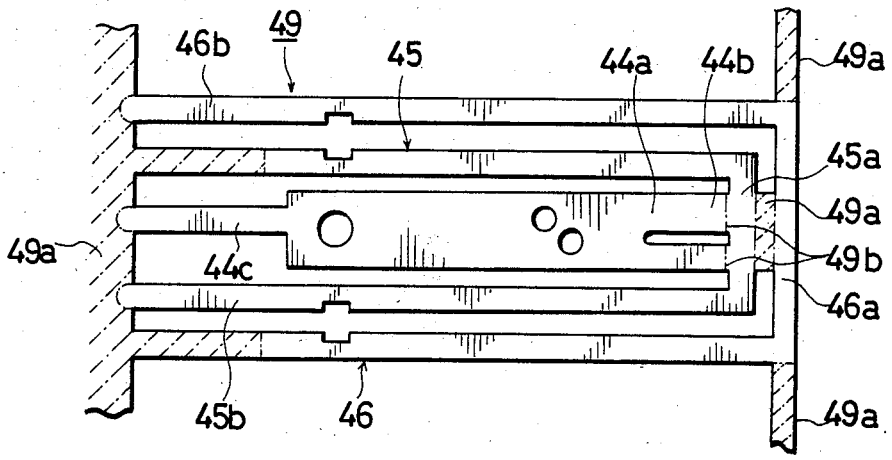
FIG. 21 is a plan view of a contact collection plate.

In the first step a contact collection plate 49 is formed by punching some metal plate in such a manner that each contact 44, 45 46 is connected to one another as illustrated in FIG. 21.

Then, in the same manner as said second embodiment, an electro-conductive film is formed only on the upper face of said contact collection plate 49. This step is not necessary when using some plated material or clad material.

Figure 22:
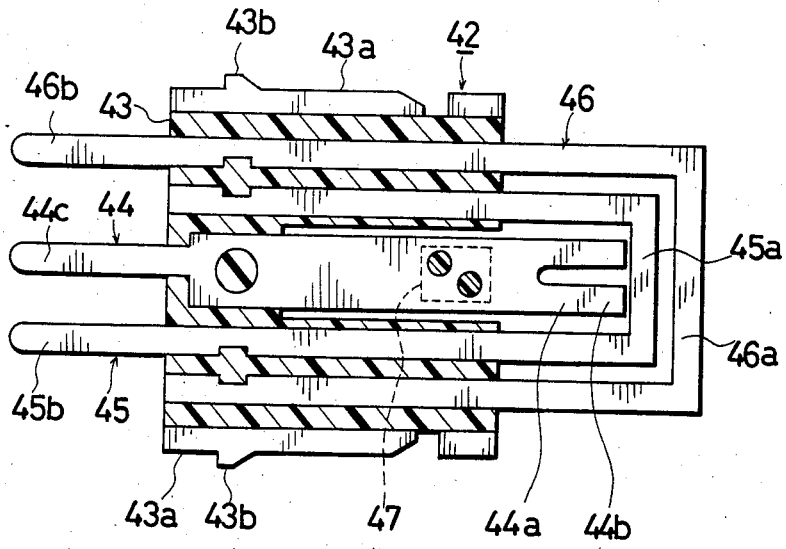
FIG. 22 is a transverse sectional view of a switch structure illustrating each contact in the developed state.
Figure 23:
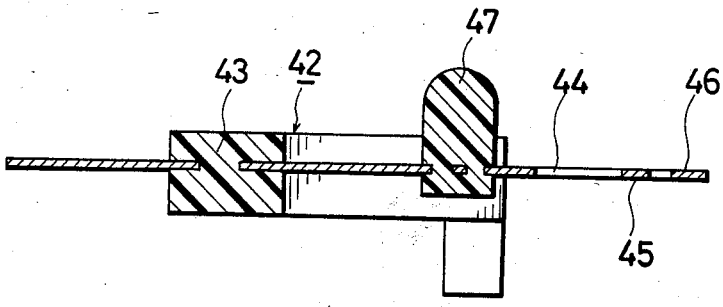
FIG. 23 is a longitudinal sectional view of a switch structure in the same state as FIG. 22.

The contact holding member 43 and the operation member 47 are then formed by injection molding of resin material while a certain part of the contact collection plate 49 is inserted in the mold. After that, every unnecessary portion 49*a* (hatching portion in FIG. 21) of the contact collection plate 49 as well as portion 49*b* connected between each end of the movable contact 44 and the first stationary contact is cut off or separated respectively. Thus, the separated contact holding member 43 is obtained, in which a part of each separated contact 44, 45, 46 is recessed to be held therein and the operation member 47 is fixed to the position near the end of the movable contact 44 as illustrated in FIG. 22 and FIG. 23.

Further by bending the end of the movable contact 44 downward to be U-shaped the upper part and the lower part thereof form the first contact area 44*a* and the second contact area 44*b* respectively, and by bending the end of the first stationary contact 45 upward to be ]-shaped the upper end thereof forms the contact area 45*a*. Then by bending the end of the second stationary contact 46 downward to be S-shaped the lower end thereof forms the contact area 46*a* and by bending the movable contact 44 upward to be inclined the first contact area 44*a* thereof is resiliently brought into contact with the contact area 45*a* of the first stationary contact 45. Furthermore the terminals 44*c*, 45*b*, 46*b* of each contact 44, 45, 46 are respectively bent to extend downward. In this manner by bending the end portion of each contact 44, 45, 46, despite the fact that the electro-conductive film is formed only on one side of the contact collection plate 49, the electro-conductive film is coated over every contact face between the opposed two pairs of the contact areas 44*a*, 45*a* and 44*b*, 46*a*.

The switch structure thus obtained is suitably used as a switch for various kinds of electrical apparatus and appliances, and particularly a jack of simplified construction can be obtained by attaching the structure 42 to a plug receiving member 48 mounted on some cabinet of the appliance, as illustrated in FIG. 19. Thus the usefulness of the switch structure in accordance with this invention is extremely high. In this respect, by applying guide rails 43*a*, 43*a* formed on both sides of the contact holding member 43 into guide grooves 48*a*, 48*a* formed on both sides of the plug receiving member 48 and by engaging a projection 43*b* provided on each rail 43*a* with a hole 48*b* of the plug receiving member 48, the switch structure is engagedly secured into said receiving member 48 while the operation member 47 projects inside the plug insertion passage 48*c*.

Concerning the number and location of each contact and such matter as whether the opposed movable contact and stationary contact are to be in contact or separated from each other in the normal state, this invention is not restricted to the above-described illustrative embodiments and it is possible to arrange them at one's option as a matter of course, and all changes which come within the meaning and the range of equivalency of the appended claims are therefore intended to be embraced therein.

What is claimed is:

1. A switch structure wherein contacts are recessed to be held, and comprising, at least one metallic stationary contact, at least one metallic movable contact, each stationary contact being associated with a movable contact, and a contact holding member of electrical insulating material for holding the stationary and movable contacts, in which each contact includes a recessed part held by the holding member, a further part to be bent relative to said recessed part, wherein the further part of each stationary contact and its associated movable contact define contact areas to perform a relative contacting and separating operation, and wherein each contact is arranged not to overlap one another when each contact is viewed in development in the same plane.

2. A switch structure as set forth in claim 1, wherein each contact is defined in a contact collection plate which in turn comprises a punched metal plate, each contact being located on the same plane of the metal plate when viewed in its developed state, while each said contact is held in said contact holding member.

3. A switch structure as set forth in claim 2, wherein the contact collection plate includes portions to be separated, and wherein each contact is formed by cutting off each portion to be separated from the contact collection plate .

4. A switch structure as set forth in claim 3, wherein at least one opening is provided in the contact holding member to be used when cutting off a portion to be separated, said at least one opening being located at a position corresponding to a recessed part in the contact holding member of each portion to be separated by cutting off when each contact is recessed in said contact holding member.

5. A switch structure as set forth in claim 4, wherein the further part of each contact is to be bent to form a facing contact area in such a manner that each facing contact area is located on the same side in the developed state of the metal plate.

6. A switch structure as set forth in claim 5, wherein each contact includes an electro-conductive film on at least one side thereof.

7. A switch structure as set forth in claim 1, wherein the contact area of at least one stationary contact is to be bent to be orthogonal to the contact area of its associated movable contact.

8. A switch structure as set forth in claim 1, wherein the recessed part of each stationary contact is supported on a supporting member formed on said contact holding member.

9. A switch structure as set forth in claim 1, wherein said contact holding member is divided into a plurality of parts and each of said parts is connected through a connecting piece which can be bent.

10. A switch structure as set forth in claim 9, wherein said connecting piece is a part of the contact.

* * * * *